United States Patent [19]

LaGra

[11] Patent Number: 4,774,986

[45] Date of Patent: Oct. 4, 1988

[54] METHOD AND APPARATUS FOR CONVERTING A HAND-HELD TOOL TO A STATIONARY TOOL

[76] Inventor: Rick LaGra, 102-49 Crumb Rd., Morton, Wash. 98356

[21] Appl. No.: 100,335

[22] Filed: Sep. 23, 1987

[51] Int. Cl.[4] ..... B25H 1/02; B27C 9/00

[52] U.S. Cl. ..... 144/1 E; 144/286 R

[58] Field of Search ..... 144/1 R, 1 E, 253 R, 144/253 J, 286 R; 83/477.2, 574

[56] References Cited

U.S. PATENT DOCUMENTS

| | | | |
|---|---|---|---|
| 3,734,151 | 5/1973 | Skripsky | 144/1 R |
| 4,114,665 | 9/1978 | Decker | 144/1 R |
| 4,186,784 | 2/1980 | Stone | 144/1 R |
| 4,350,193 | 9/1982 | McCambridge et al. | 144/1 R |
| 4,635,692 | 1/1987 | Hulse et al. | 144/286 R |

*Primary Examiner*—W. Donald Bray

*Attorney, Agent, or Firm*—Lalos & Keegan

[57] ABSTRACT

A method and apparatus for adapting a hand-held power tool to a stationary tool. An adapter plate is mounted to the top of a stationary table and is recessed such that the plate and table-top are flush. The tool housing is attached from under the table to the adapter plate using screws normally used to attach the tool base plate to the housing. A secure and stable mounting arrangement is thus provided.

7 Claims, 1 Drawing Sheet

METHOD AND APPARATUS FOR CONVERTING A HAND-HELD TOOL TO A STATIONARY TOOL

BACKGROUND OF THE INVENTION

The present invention is related to power tools and specifically the adaptation of hand-held power tools to stationary tools.

In particular, the present invention is directed to a method and apparatus for converting a power router to a stationary table-top shaper. The fixed-position stationary router provides advantages over the hand-held tool in terms of quality control, speed, and operator safety. As a stationary table-top shaper, the fixed-position router can be used for finishing, shaping, dadoing, molding cutting, beading, and laminate trimming. The tool can be used on both wood and plastics.

Hand-held power routers have a wide variety of commercial and non-commercial applications depending on the speed and power of the router. Fixing the router to a stationary work surface provides the advantages inherent in any stationary tool, for example production quality, speed of production, and operator safety. The inexpensive adaptation of a hand-held tool provides all the advantages of a stationary tool without the associated cost.

In the prior art, methods for adapting hand-held tools to stationary tools have been suggested. However, these prior art methods fail to duplicate the stability and control of a stationary tool. These prior art methods suggest the use of circular straps or clamp mechanisms to attach the router to the work table. These methods prove inadequate due to the vibration of the router and the continuous force placed on the router bit during operation. Misalignment of the router housing over time detracts from the quality of production achievable by these prior methods.

OBJECTS OF THE INVENTION

It is an object of the present invention to provide a method and apparatus for conversion of a hand-held tool to a stationary tool.

It is a further object of the present invention to provide a method and apparatus for adapting a hand-held tool to a stationary tool in which the stability and control of the tool is maintained over time.

It is a further object of the present invention to provide a method and apparatus for conversion of the hand-held tool which is simple and inexpensive.

DETAILED DESCRIPTION

Figure 1:
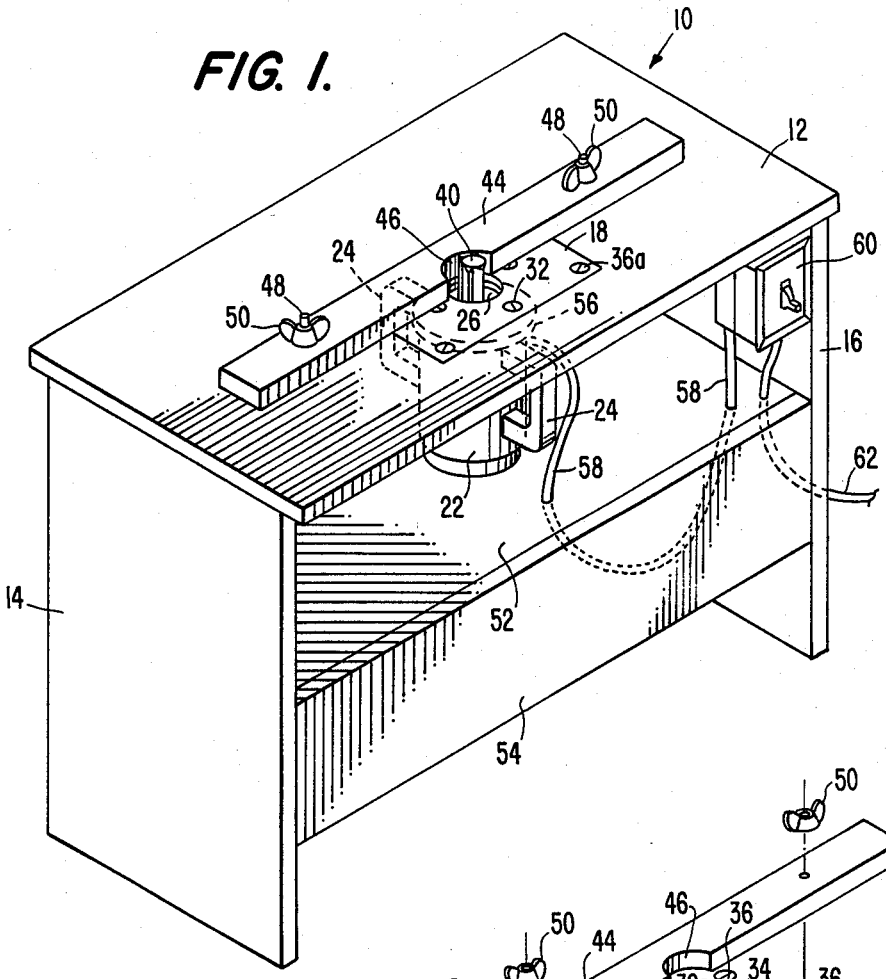
FIG. 1 is a perspective view of a hand-held router converted to a stationary tool by the method and apparatus of the present invention.
Figure 2:
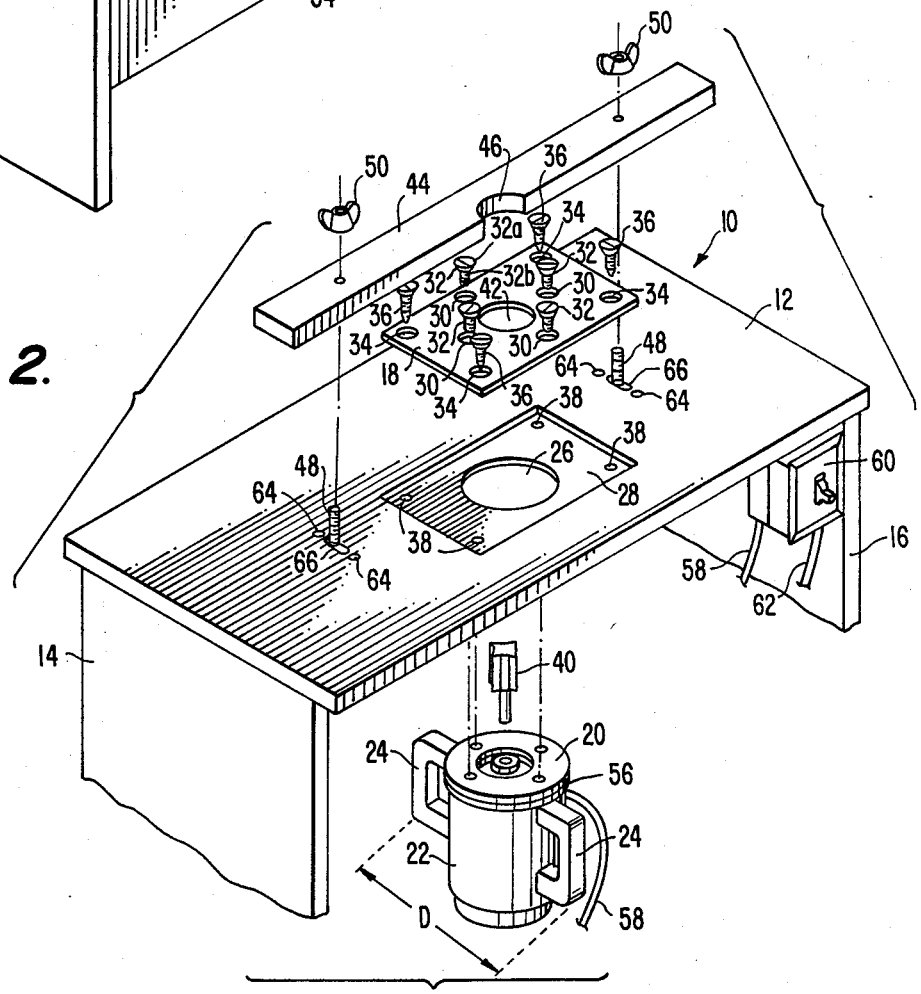
FIG. 2 is an exploded view similar to FIG. 1 but with the individual components of the present invention illustrated.

Referring to FIGS. 1 and 2, the stationary table 10 is shown with top member 12 supported by legs 14 and 16. Vertical legs 14 and 16 are substantially parallel and are secured to top member 12 by any suitable method, e.g., screws, angle-braces, etc. A horizontal shelf 52 can also be attached to legs 14 and 16 beneath router 22. In addition, vertical front cover 54 can be attached to shelf 52 between legs 14 and 16 in a perpendicular vertical plane for appearance and support. Again, shelf 52 and front cover 54 can be attached by any appropriate method. The stationary table 10 provides a stable support on which the router 20 can be mounted and on which a work piece can be guided and supported. To provide a sufficient work surface, top member 12 should be at least 36 inches by 24 inches with a minimum thickness of three-quarter inches.

An important aspect of the present invention is stability of the router 22 when mounted on table 10. This stability is achieved, in part, through the use of adapter plate 18. In the present invention, adapter plate 18 will, in effect, take the place of router base plate 20 when the router is mounted to table 10. As will be explained in greater detail, screws 32, initially used to hold base plate 20 to router 22, are utilized in the present invention to attach router 20 to adapter plate 18 and top member 12. This attachment configuration is far more secure and stable than prior art methods.

In the method of the present invention, adapter plate 18 is first centered on top member 12 of stationary table 10. The width dimension of plate 18 should be slightly greater than the diameter of base plate 20 of router 22. As an example, the width dimension can be 6 inches. The length dimension of adapter plate 18 can vary but is approximately the distance D between handles 24 of router 22. As an example, the length dimension can be 9½ inches. Adapter plate 18 is made of steel or aluminum approximately one-quarter inch thick in which holes can be drilled with a countersink. As shown in FIG. 2, a hole 42 is cut in an adapter plate 18 to receive router bit 40 or the cutting part of any power tool.

With the area of the adapter plate 18 traced on top member 12, the router 22 is then placed in the center of the traced area and a circle is drawn around the base plate 20 of router 22. A one-half inch hole (not shown) is then drilled in the center of the traced area. A hole 26 is then cut in upper surface 12 large enough to allow base plate 20 to pass through it.

Router 22, with base plate 20 removed, will be inserted into hole 26 and attached to adapter plate 18 with screws 32 as shown in FIG. 1. Base plate 20 is shown in FIG. 2 for explanation only but is removed from router 22 prior to mounting to table 10. A recess 28 is cut in upper surface 12 to receive adapter plate 18. The one-quarter inch deep recess 28 is cut using a half-inch straight-faced cutter bit in router 22. Guide strips (not shown) may be temporarily tacked around the adapter plate area to assist the recess cutting operation. In the method of the present invention, adapter plate 18 and top member 12 must be flush with each other.

Base plate 20 is removed from router 22 and used as a pattern to drill mounting holes 30 in adapter plate 18. Holes 30 are then drilled and countersunk in adapter plate 18 according to the size of the screws 32 removed from the router base plate 20. Holes 30 are sized such that the body 32*b* and not the head 32*a* will pass through adapter plate 18.

Adapter plate 18 is mounted to top member 12 by first drilling and countersinking holes 34 in adapter plate 18. Four one-inch by 10-24 machine screws 36 are then passed through adapter 18 and screwed into stationary table 10 making holes 38 and securing adapter plate 18 to top member 12. Alternatively, screws 36 can be replaced by appropriate bolts and nuts to attach plate 18 to top member 12.

Router 22 with base plate 20 removed is then passed through hole 26 and attached to plate 18 with screws 32 previously removed from base plate 20. Screws 32 are received in holes in housing 56 that are coincident with holes 30 drilled in adapter plate 18. All screws 32 and 36 are then tightened securely such that adapter 22 is held fast to stationary table 10 by means of adapter plate 18. Router bit 40 passes through hole 42 previously cut in adapter plate 18. As shown in FIG. 1, only router bit 40 will extend above the upper surface of top member 12 to contact the piece to be worked upon. As is conventional, bit 40 is mounted in a chuck (not shown) driven by a motor (not shown) mounted in housing 56 of router 22. Router bit 40 can, of course, be any cutting part of a power tool, e.g., a shaper bit or dadoing cutter, or a blade of a power saw.

Electric power to the router 22 can be controlled in any suitable manner. As shown in FIGS. 1 and 2, electric cord 58 is connected on one end to router housing 56 and on its other end to switched outlet 60. Switched outlet 60 is mounted to the lower surface of top member 12 and leg 16. Switched outlet 60 is connected to an appropriate AC power source (not shown) by electric cord 62.

A guide fence 44 with semi-circular hole 46 can be attached to top member 12 by means of bolts 48 and accompanying wing nuts 50. As an alternate embodiment, bolts 48 can be adjustably located on top member 12 in holes 64 or slot 68 to adjust the position of guide fence 44 relative to the position of router bit 40. The semi-circular hole 46 is at least partially coincident with hole 42 when guide fence 44 is attached to table 10.

From the foregoing, it is evident that the method and apparatus of the present invention provides greater stability and control than prior art methods. Further, minimal expense is required since part of the power tool itself is utilized to secure the tool to the table. Alternate embodiments of the present invention will be apparent to those having ordinary skill in the art and it is intended that such variations and modifications as falling within the spirit and scope of the invention be covered by the following claims:

I claim:

1. An apparatus for mounting a hand-held power tool to a stationary table comprising:

a table with a substantially horizontal top member;

a power tool comprising a housing, a removably attached base plate secured to said housing by screws, said screws passing through base plate holes and into aligned housing holes when said base is attached to said housing, and a cutting part;

an adapter plate mounted to an upper surface of said top member;

said adapter plate including a first hole for receiving said cutting part, said first hole having a diameter small enough to prevent said housing from passing through said first hole, said adapter plate further including a plurality of second holes, said second holes positioned in said adapter plate to be aligned with said housing holes when said cutting part is received in said first hole; and means for mounting said power tool to a lower surface of said top member, said means for mounting including said tool housing with said base plate removed, said screws and said adapter plate, whereby said screws pass through said second holes in said adapter plate mounted on the upper surface of said top member and into said housing holes to secure said housing to said stationary table.

2. Apparatus according to claim 1 including a recess in said top member for receiving said adapter plate such that the upper surface of said adapter plate is flush with the upper surface of said top member.

3. Apparatus according to claim 1 including a hole in said top member for receiving said housing such that said housing is in contact with said adapter plate when said tool is attached to said plate by said screws.

4. Apparatus according to claim 1 including a guide fence with a substantially semi-circular hole, said guide fence being attached to said top member such that said semi-circular hole and said first hole of said adapter plate are at least partially coincident.

5. A method for mounting a hand-held power tool to a stationary table, said power tool including a cutting part, a housing, and a removable base plate secured to said housing by a plurality of screws, said method comprising:

cutting a first hole in an adapter plate for receiving said cutting part of said power tool;

removing said base plate from said tool and, using said base plate as a pattern, drilling a plurality of second holes in said adapter plate for receiving said screws;

cutting a third hole in said table to receive said tool housing, said third hole being larger in diameter than said first hole;

attaching said adapter plate to an upper surface of said table such that said first hole and said third hole are aligned;

placing said tool housing through said third hole and adjacent said adapter plate and aligning said second holes in said adapter plate with screw holes in said tool housing; and inserting said screws through said plurality of second holes in said adapter plate and into said screw holes in said tool housing, whereby said tool is secured to said adapter plate and said table.

6. A method according to claim 5 including the step of cutting a recess in said table for receiving said adapter plate whereby the upper surface of said adapter plate is flush with the upper surface of said table when said adapter plate is attached to said upper surface.

7. A method according to claim 5 including attaching a guide fence with a substantially semi-circular hole to said table such that said semi-circular hole and said first hole in said adapter plate are at least partially coincident

* * * * *